US009683514B2

(12) United States Patent
Herr

(10) Patent No.: US 9,683,514 B2
(45) Date of Patent: Jun. 20, 2017

(54) HIGH EFFICIENCY COMBUSTOR AND CLOSED-CYCLE HEAT ENGINE INTERFACE

(75) Inventor: John David Herr, Bellefonte, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 100 days.

(21) Appl. No.: 14/006,530

(22) PCT Filed: Mar. 16, 2012

(86) PCT No.: PCT/US2012/029403

§ 371 (c)(1),
(2), (4) Date: Sep. 20, 2013

(87) PCT Pub. No.: WO2012/129079

PCT Pub. Date: Sep. 27, 2012

(65) Prior Publication Data

US 2014/0007570 A1 Jan. 9, 2014

Related U.S. Application Data

(60) Provisional application No. 61/454,641, filed on Mar. 21, 2011.

(51) Int. Cl.

| | |
|---|---|
| ***F02G 1/04*** | (2006.01) |
| ***F02G 1/057*** | (2006.01) |
| ***F02G 1/055*** | (2006.01) |

(52) U.S. Cl.

CPC ..... *F02G 1/057* (2013.01); *F02G 1/055* (2013.01); *F02G 2254/10* (2013.01)

(58) Field of Classification Search

CPC ..... F02G 1/057; F02G 1/055; F02G 2254/10; F24D 9/00

(Continued)

(56) References Cited

U.S. PATENT DOCUMENTS 3,842,820 A * 10/1974 Michels et al. ..... 126/110 R
5,643,348 A * 7/1997 Shamp ..... C03B 5/2353 432/196
5,950,616 A * 9/1999 Armentrout ..... F24H 3/087 126/106

FOREIGN PATENT DOCUMENTS

DE 3502308 A1 * 10/1985
GB 630429 A * 10/1946
WO WO 2007077293 A1 * 7/2007

* cited by examiner

*Primary Examiner* — Jason Shanske
*Assistant Examiner* — Kelsey Stanek
(74) *Attorney, Agent, or Firm* — Chrsitopher A. Monsey

(57) ABSTRACT

A powering system includes an engine having a first side and an interface for providing heat to the first side of the engine. The interface includes a combustor having a combustion chamber positioned at least partially in an enclosure that receives a fuel and an oxidizer for combustion of the fuel and oxidizer into a combustion product. A conduit is connected to the combustion chamber for receiving the combustion product. A heat transfer fluid is positioned in the enclosure and engages an external surface of the combustion chamber and an external surface of the conduit within the enclosure. The heat transfer fluid is heated by the combustion product via the external surface of the combustion chamber and the external surface of the conduit such that the heat transfer fluid transfers heat to the first side of the engine. The heat transfer fluid may thereby decouples the engine from the combustor.

65 Claims, 7 Drawing Sheets

(58) Field of Classification Search
USPC ..... 60/526, 517
See application file for complete search history.

HIGH EFFICIENCY COMBUSTOR AND CLOSED-CYCLE HEAT ENGINE INTERFACE

CROSS-REFERENCE TO RELATED APPLICATION

The present application is a 371 National Phase filing of International Application No. PCT/US2012/29403, filed Mar. 16, 2012, which claims priority to U.S. Provisional Application No. 61/454,641 filed Mar. 21, 2011, the disclosures of which are expressly incorporated by reference herein.

STATEMENT REGARDING FEDERALLY SPONSORED RESEARCH

This invention was made with government support under Office of Naval Research Contract No. N00024-02-D-6604/0581, Code 823, which was awarded by the Office of Naval Research. The U.S. government has certain rights in the invention.

FIELD OF INVENTION

The present invention relates to powering systems that may utilize heat engines, heat exchangers, Stirling engines, heat pipes, combustors and engines. Embodiments of the invention may be configured to incorporate an integral combustor and heat engine or other engine that utilizes an interface for the combustor and engine components to minimize, if not eliminate, at least one of: (a) parasitic heat loss from combustor walls, (b) circumvent the need for pumping excess diluents into the combustor, and (c) the potential for overheating the hot side of the engine. Some embodiments of the present invention may be configured for use in engine designs, external combustion engine designs, heat engine designs, and other devices utilizing a combustor. Some embodiments of the invention may be utilized in naval vessels such as submergible ships and surface craft. Other embodiments of the invention may be utilized in portable power plants or generators that are configured for ground-use, space systems or underwater applications.

BACKGROUND OF THE INVENTION

U.S. Patent Application Publication No. 2010/0212656 and U.S. Pat. Nos. 6,739,136, 4,785,875, 4,753,072, 4,685,510, 4,671,064, 4,135,367, 4,010,018 disclose examples of different structures, designs and methods by which heat exchangers, Stirling engines, heat engines, and other engines function. Such systems often utilize a working fluid for transferring heat. Usually, such systems utilize a hot combustor exhaust gas to directly fire a hot side of the engine for transferring that heat and powering a device.

Small scale combustion, such as combustion that is used in heat engines to power underwater or space vehicles or small electric generators, often utilize small combustors that have significant design issues that prevent the combustors from operating efficiently. For instance, small combustors usually have large surface area to volume ratios, and thus have high parasitic heat loss. That is, the heat release rate varies approximately with the volume of the combustor while the heat loss from the combustor walls varies with the combustor surface area. A small scale combustor may thus have high parasitic heat loss as the heat lost through the combustor walls is usually transferred to the environment rather than a heat engine. As a result, the powering system's energy efficiency decreases. Coupling a small scale combustor with a Stirling engine presents a substantial design challenge as the exit temperature of the combustor must not be excessive or the hot side of the closed cycle heat engine will melt or otherwise deform from excessive thermal stresses that are limited by the material properties of the structures. This typically requires that excess diluents be introduced into the combustor or exhaust stream. For instance, burning kerosene with air may produce combustor exhaust temperatures well in excess of 3000° F. that would either melt or deform iron-based, cobalt-based, nickel-based, or chromium-based alloys and super alloys commonly used in the construction of a hot side of a closed cycle heat engine. Excess diluent must then be pumped into the combustor to prevent engine damage. The diluent is often excess air or exhaust products. The excess diluent presents two additional losses to the system efficiency as additional power or mechanical work is usually required to pump the diluents into the combustor and the diluent exits the hot side of the engine at a high temperature and represents an additional thermal loss to the system. In addition, since the required diluent mass and volume flow rates are usually many times that of the combustion products, the combustor must be made larger in order to accommodate the excess flow, which increases its weight and volume and further exacerbates the parasitic heat loss discussed above.

Prior art combustion devices for powering a closed-cycle heat engine, especially those for small power applications of about 5 kW or less of electrical power or shaft power, lose a significant fraction of the chemical power of combustion as heat loss through the combustor walls. This heat is ultimately transferred to the environment via a cooling jacket or insulation rather than powering the heat engine. Furthermore, piping the hot combustion gases to the heat engine is problematic if the exhaust gases are not tempered by dilution with either excess air or cooled exhaust products. These heat losses usually dictate that the combustor be designed as small as possible to reduce these parasitic losses, however, small combustors have short residence times that sometimes do not provide complete combustion or result in intermediate or frozen combustion products that lower the furnace efficiency of the thermal heat source.

A new design is needed that may improve the performance of engines and heat exchanges that such engines may be designed to drive or utilize. Such a design preferably permits a reduction in complexity in engine design while maximizing the thermal efficiency of the power system.

SUMMARY OF THE INVENTION

A powering system is provided. The powering system may be utilized in naval vessels such as submergible ships and surface craft or other vehicles. Other embodiments of the powering system may be utilized in portable power plants or generators that are configured for ground-use, space systems or underwater applications. In some embodiments, the powering system may be utilized to generate electricity. Other embodiments may be configured to generate mechanical work be causing movement of a structure, such as a drive shaft or other member.

One embodiment of the powering system may include an engine having a first side and an interface for providing heat to the first side of the engine. The interface may include an enclosure and a combustor having a combustion chamber positioned at least partially in the enclosure. The combustion chamber receives a fuel and an oxidizer for combustion of the fuel and oxidizer into a combustion product. The interface may also include a conduit connected to the combustion chamber for receiving the combustion product. The conduit may be positioned at least partially in the enclosure. The interface may also include a heat transfer fluid positioned in the enclosure. The heat transfer fluid engages an external surface of at least one wall of the combustion chamber and an external surface of the conduit within the enclosure. The heat transfer fluid may be heated by the combustion product via the external surface of the combustion chamber and the external surface of the conduit such that the heat transfer fluid transfers heat to the first side of the engine.

In some embodiments, the heat transfer fluid may be heated by the combustion product via the external surface of the combustion chamber and the external surface of the conduit such that the heat transfer fluid boils and vapor contacts the first side of the heat engine and condenses adjacent the first side of the heat engine to transfer heat to the first side of the engine. In other embodiments, the heat transfer fluid may be a liquid and the combustion chamber and a portion of the conduit may be positioned within the liquid. In one such embodiment, the liquid may be a liquid metal or an organic material.

The engine of the powering system may be any of a number of types of engines. For example, the engine may be a heat engine, an external combustion engine, a Rankine cycle engine, a Brayton cycle engine, or a Stirling engine. The first side of the engine may include a heat exchanger. A cool side of the engine may also include a heat exchanger.

Embodiments of the powering system may include a heat transfer fluid movement mechanism connected to the enclosure. The heat transfer fluid movement mechanism may be configured to movie the fluid. For example, the heat transfer fluid movement mechanism may include an agitator that is moved to stir the heat transfer fluid. Movement of the fluid may increase the rate at which heat is convectively transferred.

The combustion chamber may be configured so that it does not receive any diluent and the external surface of the combustion chamber directly contacts the heat transfer fluid. Other embodiments may be configured so that a small portion of diluent is provided or so that the heat transfer fluid does not directly contact the heat transfer fluid.

Some embodiments of the powering system may include a recuperator connected to the conduit so that heat from the combustion product passing through the conduit preheats at least one of the fuel and the oxidizer prior to the at least one of the fuel and the oxidizer being fed to the combustion chamber. The conduit may have an exhaust outlet and the combustion product may be passed through the exhaust outlet after passing through the recuperator.

A portion of the conduit within the enclosure may be coiled or serpentine tubing or may be a pipe or other conduit that defines a coiled or serpentine path within the enclosure. The portion of the conduit within the enclosure may be a heat exchanger and provides additional residence time for complete combustion of the fuel and oxidizer when the combustor operates at a steady state condition and the combustion product exits enclosure via the conduit.

The conduit may have many different configurations. In one configuration, a first portion of the conduit may be within the enclosure and a second portion of the conduit may be within a recuperator and a third portion of the conduit may be between the recuperator and the first portion of the conduit.

The powering system may be utilized to combust multiple different fuel types. For instance, the fuel may be jet fuel, methane, an alcohol, kerosene, or a hydrocarbon fuel. Additionally the heat transfer fluid may be any of a number of different fluids. For instance, the heat transfer fluid may be a liquid metal, sodium, lithium, sodium-potassium alloy, potassium, a salt (e.g. LiCl, LiF, NaCl, NaF, etc), a phase-change fluid (e.g. LiH), oil, or an organic fluid that has a suitable vapor pressure and does not decompose at the desired hot-side temperature of the heat engine.

A powering system for a vehicle is also provided. The system may include an engine having a hot side and interface means for providing heat to the hot side of the engine. The interface means comprises an enclosure, combustor means for receiving a fuel and an oxidizer for combustion of the fuel and oxidizer into a combustion product, heat exchanger means for receiving the combustion product and cooling the combustion product, and a heat transfer fluid positioned in the enclosure to decouple the engine from the combustor means. The heat transfer fluid may engage the combustor means and the heat exchanger means to receive heat from the combustor means and the heat exchanger means to transfer the heat to the hot side of the engine. It should be appreciated that the heat exchanger means is connected to the combustor means and is at least partially positioned within the enclosure.

The engine may be a Stirling engine and the hot side of the Stirling engine may be a heater head of the Stirling engine. The engine could alternatively be a heat engine, external combustion engine, Rankine cycle engine, Brayton cycle engine, or other type of engine. The engine produces mechanical work or electrical work.

The combustor means may be operated under any of a number of conditions. Preferably, combustor means is operated without use of any diluent to avoid parasitic heat loss associated with the use of a diluent.

The heat transfer fluid may be in direct contact with the hot side of the engine to transport heat to the hot side of the engine. Alternatively, it is contemplated that the heat transfer fluid may be positioned adjacent to but spaced apart from the hot side of the engine for transporting heat to the hot side of the engine.

In some embodiments, the heat exchanger means may be configured so that a predetermined residence time of the gases that exit the combustor means and enters the heat exchanger is provided via a length of the heat exchanger means so that the any unburned propellants or reduction of incomplete combustion products are converted to their final equilibrium state to maximize furnace efficiency of the combustor means. Such a predetermined length that is needed for providing either complete combustion or substantially complete combustion may be determined via routine testing or an estimate based on a conventional thermodynamic calculation method.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of combustor and engine interfaces, powering systems used for engine designs, and method utilizing such designs are shown in the accompanying drawings. It should be appreciated that like reference numbers used in the drawings may identify like components.

DETAILED DESCRIPTION OF PRESENT PREFERRED EMBODIMENTS

Figure 1:
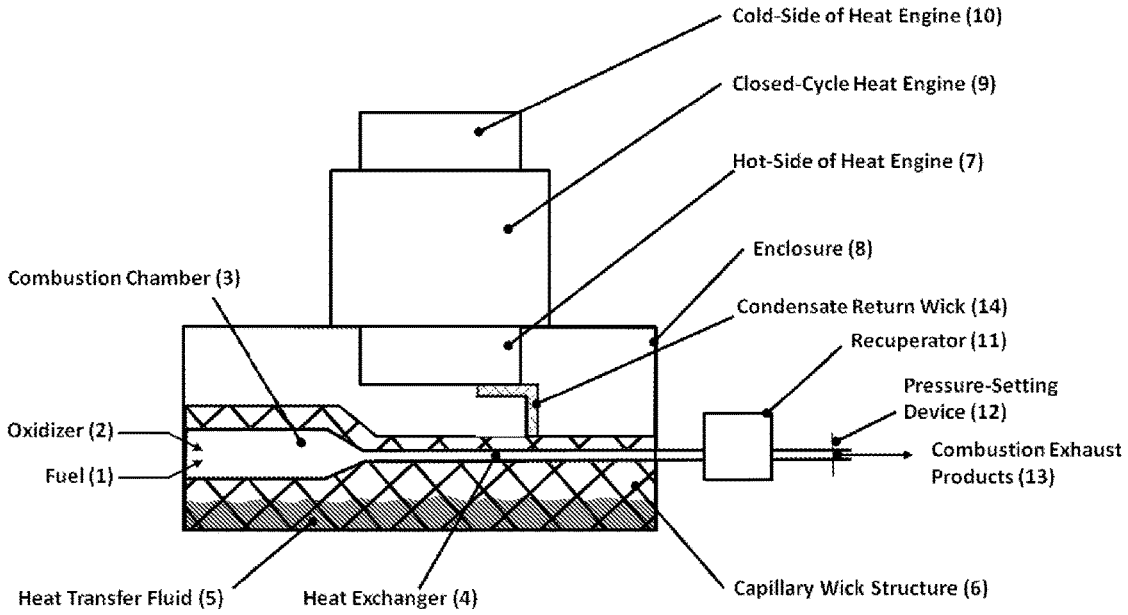
FIG. 1 is a schematic view of an exemplary embodiment of an engine configured to utilize an embodiment of the power system that includes an evaporatively cooled combustor and closed cycle heat engine interface.

Referring to FIG. 1, an exemplary embodiment of a powering system is illustrated in connection with an integral combustor and heat engine interface design. The embodiment shown in FIG. 1 utilizes a combustion chamber that is cooled via evaporation of a working fluid that then condenses on the hot side of a closed cycle heat engine to make useful work. The generated work may power a device such as a naval vessel, a vehicle, or other device.

Fuel 1 and an oxidizer 2 are burned in the combustion chamber 3 of a combustor to convert chemical energy into thermal energy. The fuel may be any of a number of suitable fuels for undergoing combustion, such as jet fuel, kerosene, gasoline, diesel, methanol, or methane. The oxidizer 2 may be any of a number of suitable oxidizers, such as pure oxygen, gas having a predefined content of oxygen, hydrogen peroxide, oxides of nitrogen or air.

The hot combustion products exit the combustion chamber and flow into a heat exchanger 4 that is attached to the aft end of the combustor. The size and shape of the heat exchanger 4 may be configured to provide a greater surface area for purposes of providing heat transfer from the hot flow of combustion products passing through the heat exchanger 4 to the heat transfer fluid 5. The heat exchanger 4 may be a conduit through which the hot combustion products pass that is adjacent to a heat transfer fluid 5. The heat transfer fluid 5 may be sodium, lithium, sodium-potassium alloy, potassium, or other organic fluid that has a suitable vapor pressure and does not decompose at the desired hot-side temperature of the heat engine. The conduit through which the combustion products pass may be a straight pipe or tube, or may be a tube, pipe or other conduit that is coiled or serpentine to define a path for the combustion products. The conduit may utilize any of a number of dimensions and configurations to increase the surface area of the conduit through which the combustion products pass for transferring the heat from the combustion products to the transfer fluid 5. For example, the conduit may utilize fins that are straight, coiled, or serpentine in arrangement.

The heat exchanger 4 may also utilize other designs or incorporate other structure in alternative embodiments. For instance, alternative embodiments may utilize a heat exchanger utilizing parallel flow paths of the heat transfer fluid 5 and combustion products similar to those in a shell and tube heat exchanger. The combustion products may then be cooled to the temperature of the heat transfer fluid 5 before exiting the enclosure.

By incorporating a length of heat exchanger conduit to the aft end of the combustor, the combustion exhaust gas may be cooled to within tens of degrees Fahrenheit of the heat transfer fluid 5. The heat exchanger 4 also serves to increase the residence time of the exhaust products such that any incomplete combustion products are converted to their equilibrium products. For example, any residual oxygen and carbon monoxide in the exhaust will react or burn in the heat exchanger 4 conduit to form carbon dioxide and thereby increase the furnace efficiency of the device.

In addition to being positioned adjacent to the conduit through which the hot combustion products pass, the heat transfer fluid 5 may be positioned adjacent to the combustor chamber. Preferably, the transfer fluid is in direct contact with the exterior surface of the combustor chamber walls and at least a substantial portion of the exterior surface of the conduit through which the combustion products pass. The thermal energy of the combustion products is transferred through the combustion chamber walls and heat exchanger walls to the heat transfer fluid 5. The heat transfer fluid may be pumped or otherwise moved to the combustor and heat exchanger walls via any of a number of structures. For instance, a capillary wick structure 6 may be utilized so that a pump is not needed to drive such movement of the fluid.

The combustion chamber 3, heat exchanger 4 and hot side 7 of the heat engine as well as the capillary wick structure 6 and heat transfer fluid 5 are positioned in an enclosure 8, which may be a housing or other structure sized and configured to retain and support these elements. It should be understood that the combustion chamber 3, heat exchanger 4, hot side 7 of the heat engine, and capillary wick structure may be attached or coupled within the enclosure 8. The transfer fluid may be positioned within a cavity defined in the enclosure 8 so that the transfer fluid 5 is in contact with at least the combustor 3, heat exchanger 4 and capillary wick structure 6. It is contemplated that the heat transfer fluid 5 could be positioned in the cavity of the enclosure so that it is also in contact with the hot side 7 of the heat engine or is at least positioned adjacent to the hot side 7 of the heat engine as well.

The heat engine 9 may operate under a closed cycle that operates over a thermodynamic cycle between the hot side 7 of the heat engine and the cold side 10 of the heat engine to make mechanical or electrical work from the combustion process. Such mechanical or electrical work may power a device. Common thermodynamic heat cycles that may use this innovation include the Stirling, Rankine and Brayton cycles that constitute a power source for powering a propulsion system. Other types of external combustion engines may also be utilized as engines having a hot side in embodiments of the system. Such external combustion engines could also be considered a heat engine.

Electricity generated as electrical work from the engine may be passed to the propulsion system via a connector to power the propulsion system, for example. As another example, mechanical work may result in a rod or other structure being moved by the engine. Such movement may power motion of other elements coupled to the moved structure to power a component of the device, such as a rotor or propeller of a propulsion system. The moved structure may alternatively be a drive shaft of a vehicle and the motion of the drive shaft may drive movement of other components coupled to the drive shaft for moving the vehicle.

After passing through the heat exchanger 4 and cooling to approximately the temperature of the heat transfer fluid 5, the combustion exhaust gas may exit the enclosure 8 via the conduit of the heat exchanger through which the combustion products pass. To further increase the efficiency of the heat exchanger, recuperator 11 may be connected to preheat either the fuel 1 or oxidizer 2 or both. An optional pressure setting device 12 such as an orifice or back pressure regulator may also be utilized to operate the combustor at elevated pressure, if desired, to minimize the size of the combustor and heat exchanger. For example, a feed conduit through which the oxidizer 2 passes and a conduit through which the fuel passes for being fed to the combustor may pass through the recuperator 11 so that additional heat from the combustion products may be transferred to the oxidizer 2 and fuel 1 prior to being fed to the combustor 3.

The pressure setting device 12 may be configured to regulate the flow of combustion products to control the pressure of the combustor 3 and heat exchanger 4. The pressure setting device may be a valve, for example, that is controlled by an automated process control mechanism. The automated process control mechanism may be a computer or controller communicatively coupled to the valve to control functionality of the valve for controlling the pressure to be within a tolerance range of a desired operating pressure set point, for example.

The combustion exhaust products 13 may then be throttled or vented to the environment to complete the process. For instance, the exhaust may be fed to outside of the body of a vehicle to be transported to the air or space by a portion the body of the vehicle or another portion of the Earth's atmosphere or into the space above the Earth's atmosphere.

In the design of the powering system illustrated in FIG. 1, the heat transfer fluid 5 may be wicked via capillary action from the bottom of the enclosure to the combustion chamber walls and heat exchanger walls. The thin film of liquid may then evaporate or boil. The hot vapor of the heat transfer fluid 5 so generated may then condense on the hot side 7 of the heat engine 9. In some designs, the condensed (and as a result now liquid) heat transfer fluid then falls back to the bottom of the enclosure via gravity where a pool of heat transfer fluid 5 may be positioned for passing through the wicks of the wick structure 6 and is commonly referred to as a thermosyphon. Other designs may utilize a condensate return wick 14 that functions to reflux the heat transfer fluid condensate to the capillary structure surrounding the combustion chamber and heat exchanger walls to form a heat pipe in the event gravity is not sufficiently present or if gravity acts in an adverse direction.

It should be understood that the working fluid side of the combustor walls and heat exchanger surface should be covered with capillary wick structures that are sufficient for moving sufficient working fluid to the combustor walls and heat exchanger walls to account for evaporative cooling. The wicks of the wick structure 6 may be any of a number interconnected wicks or network of wicks. The wicks may be wire screens, metal felts, metal foams, sintered or loose metal particles or any other porous matrix that is wetted by the heat transfer fluid 5 and has a melting point well above the hot-side operating temperature of the heat engine.

Figure 2:
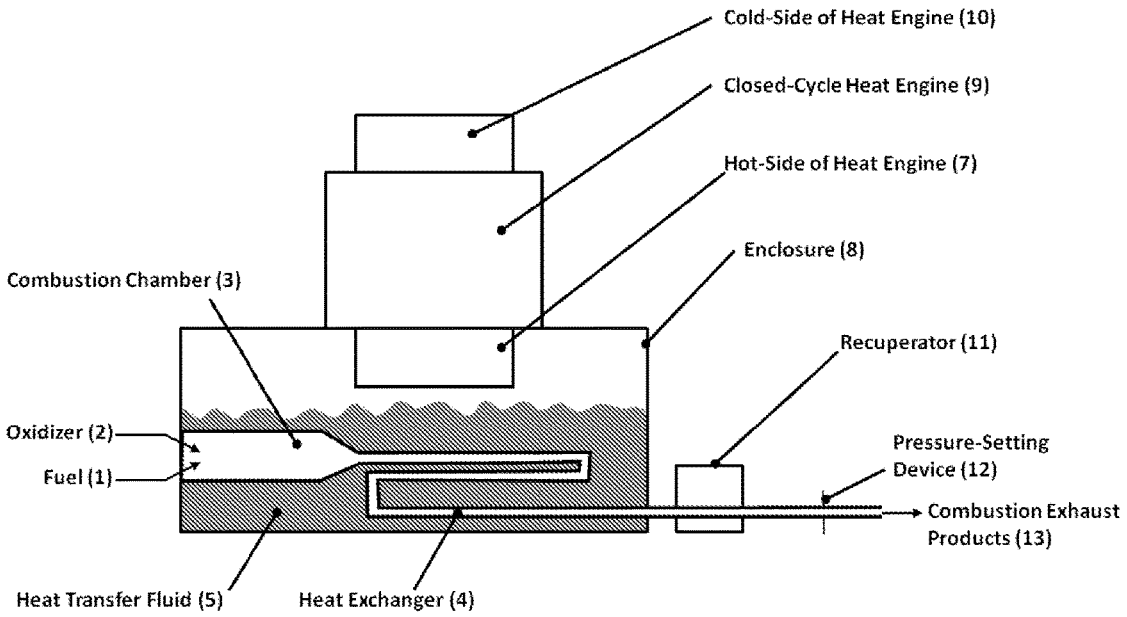
FIG. 2 is a schematic view of an exemplary embodiment of an engine configured to utilize an embodiment of the power system that includes a pool boiler combustor and closed cycle heat engine interface.

An alternative powering system embodiment may utilize a pool boiler configuration. One example of such an embodiment is illustrated in FIG. 2. In the powering system shown in FIG. 2, fuel 1 and an oxidizer 2 are burned in the combustion chamber 3 to convert chemical energy into thermal energy. The hot combustion products exit the combustion chamber and flow into a heat exchanger 4 that is attached to the combustor 3. Both the combustor 3 and heat exchanger 4 may be submerged in the heat transfer fluid 5 to facilitate the transfer of heat to the heat transfer fluid 5. The heat transfer fluid 5 may be a liquid that is heated via the heat transfer and subsequently boils, which cools the combustor chamber 3 and heat exchanger 4 due to the transfer of heat that thereby occurs. The boiling heat transfer fluid 5 generates vapor that condenses on the hot side 7 of a closed cycle heat engine 9. The condensed fluid may then fall back to the pool of fluid that encloses or at least partially encloses the combustor 3 and heat exchanger 4. An enclosure 8, such as a housing, may enclose the combustor, heat exchanger, heat transfer fluid, and a portion of the hot side 7 of the heat engine. These components may be attached to the enclosure or positioned within the enclosure.

It should be understood that, as in the embodiment discussed above, the working fluid side of the combustor walls and heat exchanger surface may also be covered with a wick structure to facilitate transfer of the liquid heat transfer working fluid. In addition, the surface of the combustor may be fabricated in a fashion that increases the effectiveness of heat transfer (via convection, and/or boiling) to the working fluid. Enhancements may include the presence of fins or other extended heat transfer structures or surface treatments such as grit blasting or knurling to increase nucleation sites to enhance boiling.

Figure 3:
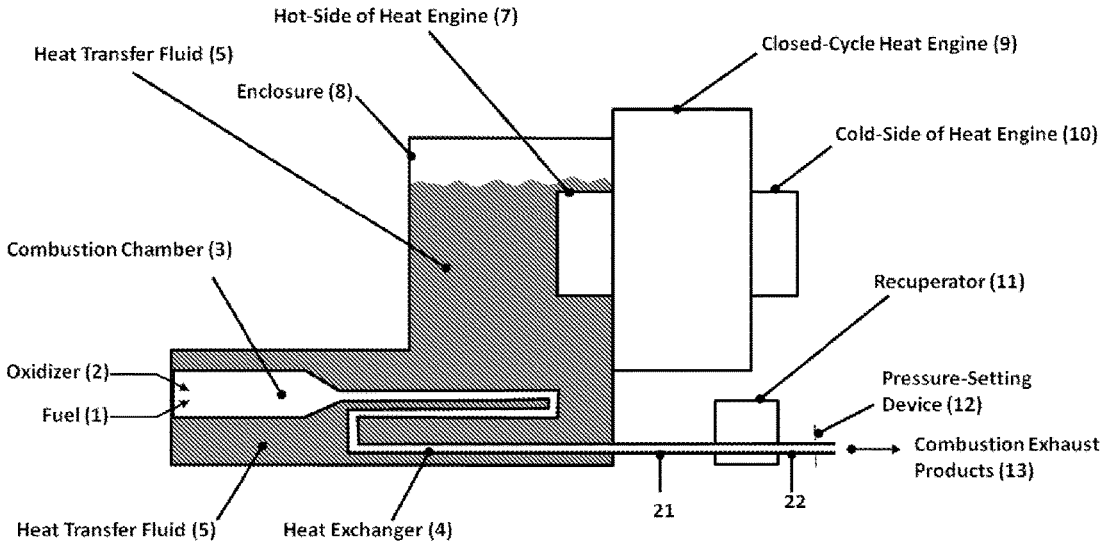
FIG. 3 is a schematic view of an exemplary embodiment of an engine configured to utilize an embodiment of the power system that includes convectively cooled combustor and closed cycle heat engine interface.

Referring to FIG. 3, yet another alternative embodiment of the powering system may utilize both a combustion chamber and hot side of a heat engine submerged in a pool of heat transfer fluid that is subcooled (e.g. below the boiling point). Such an embodiment may utilize a design that permits the combustor to be convectively cooled while providing an interface with a closed cycle heat engine. Another form of this third embodiment of the power system replaces the hot end of the heat engine with a cooling coil in which a fluid (such as water or an organic medium) is boiled, with the resulting steam or vapor used to power a Rankine cycle engine or other external combustion engine. Alternately, the working fluid can be a gas that is heated and then expanded in a Brayton cycle or other external combustion engine.

The combustion chamber 3 and at least a portion of the heat exchanger 4 may be attached within an enclosure 8. Heat transfer fluid 5 may be positioned in a cavity in which a portion of the heat exchanger 4 and combustion chamber 3 are located. At least a portion of a hot side 7 of a heat engine 9 may be attached within or positioned in the enclosure 8 as well. The heat transfer fluid 5 may be in direct contact with at least a portion of the hot side 7 of the heat engine 9. The heat engine may be attached to the enclosure 8 so that the cold side 10 of the heat engine 9 is positioned on a side of the heat engine that is opposite the hot side 7 of the heat engine 9.

The heat of the combustion products may be transferred to the fluid via the walls of the combustion chamber and wall of the at least one conduit of the heat exchanger 4. The heat from the combustion products may supply thermal energy to the hot side of the heat engine and act to transfer heat to the hot side 7 of the heat engine 9.

A recuperator 11 may be positioned to receive a portion of a conduit through which combustion exhaust products 13 pass. A portion of one or more conduits through which oxidizer and fuel passes may also pass through the recuperator 11 to receive heat from the recuperator to pre-heat the fuel 1 and oxidizer 2 prior to being combusted in the combustion chamber. A pressure setting device 12 may be connected to an exhaust conduit that is connected to the conduit of the heat exchanger 4 that is positioned in the enclosure 8.

In some embodiments, a single conduit may define a path from the combustion chamber to an exhaust outlet. That path may include a first portion that functions as a heat exchanger to provide a heat transfer to the heat transfer fluid 5 and may include a second portion through which the combustion products pass through the recuperator 11. There may be a first intermediate portion 21 of the path positioned between the heat exchanger 4 and recuperator 11 and also an exhaust portion 22 that is positioned between the exhaust outlet and the recuperator 11 through which combustion products pass prior to being passed out of the exhaust outlet. The first intermediate portion 21 of the path may be external or substantially external to the enclosure 8 and external or substantially external to the recuperator 11.

It should be appreciated that the heat transfer fluid could be mechanically stirred or pumped within the enclosure to provide a necessary convection coefficient for heat transfer between the heat engine and combustion chamber 3 and heat exchanger 4. Such stirring or movement of the heat transfer fluid 5 may improve the rate at which heat is transferred, for example. It should be understood that such movement of the heat transfer fluid may be most suitable for heat engines designed for relatively low-temperature operations. For example, it is contemplated that for some high-temperature applications, stirring, circulating, or otherwise moving the heat transfer fluid 5 may be impractical due to other design considerations, such as material properties of the enclosure and design requirements for mechanisms needed to provide such fluid movement at the operational temperature of the system. Preferably, the heat transfer fluid is a liquid metal or other fluid that has a high thermal conductivity as such a heat transfer fluid can support high heat fluxes via stirring by buoyancy-induced temperature gradients (natural circulation or convection). The temperature gradients for such heat transfer fluids may be much higher than those of a heat pipe or pool boiler configurations, such as those discussed with reference to FIGS. 1 and 2. Of course, as an alternative to a liquid metal heat transfer fluid, it is contemplated that embodiments may utilize a salt (e.g. LiCl, LiF, NaCl, NaF, etc), phase-change fluid (LiH), oil, or other types of liquids as the heat transfer fluid 5.

Figure 4:
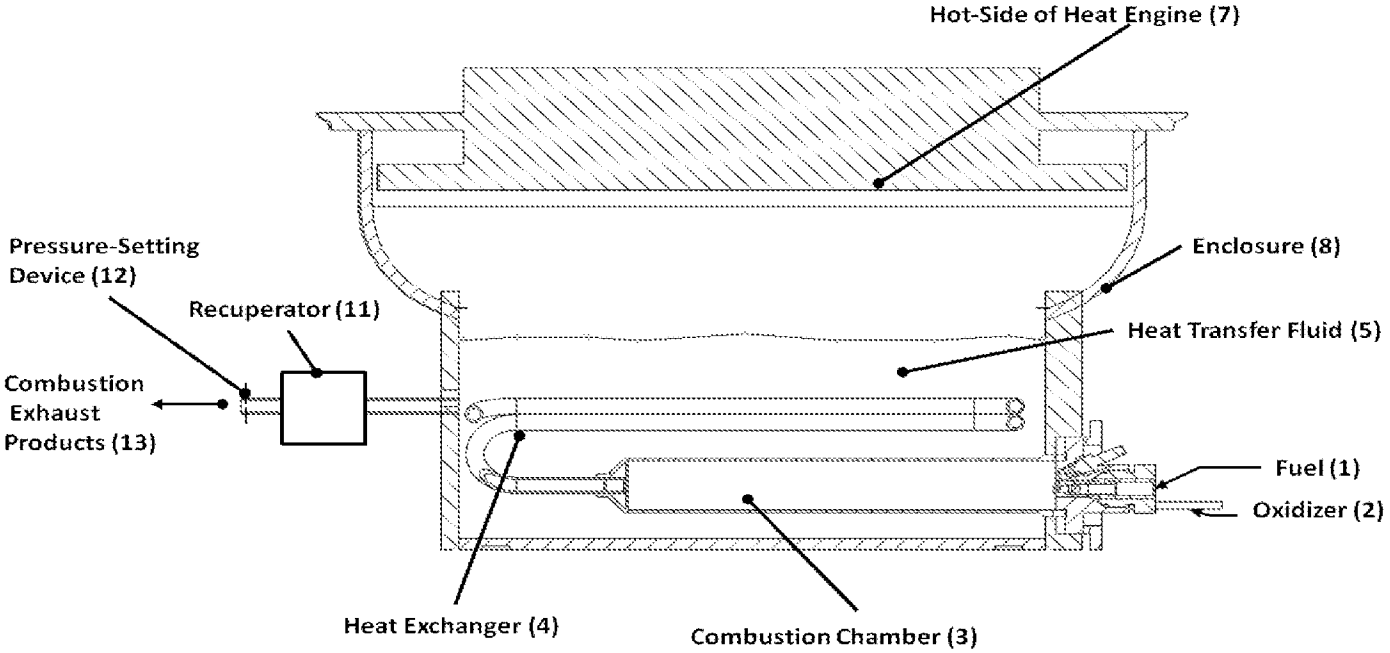
FIG. 4 is a fragmentary cross sectional view of an exemplary embodiment of a Stirling engine that utilizes an embodiment of the powering system that has a combustor embedded in a pool boiler.

Referring to FIG. 4, an embodiment of the powering system may utilize a Stirling engine, which may be a heat engine, that is powered with a combustor 3 embedded in a pool boiler. The combustor may be fed fuel 1 and an oxidizer 2 to be combusted in a combustion chamber 3 of the device. The combustor may be embedded in a pool boiler that utilizes a heat transfer fluid 5 that is in contact with the walls of the combustor that define the combustion chamber 3 of the combustor. The combustion chamber 3 may be positioned within an enclosure 8. The heat transfer fluid 5 may also be in contact with a first portion of a conduit of a heat exchanger through which the combustion product, which is a hot gas that includes carbon dioxide, carbon monoxide, and steam, passes. The first portion of the conduit may be positioned completely or mostly in the enclosure 8 and may be considered a heat exchanger 4 as heat from the combustion products are transferred through the wall or walls of the conduit to the heat transfer fluid.

The combustor may be configured to operate by combusting multiple different fuels at different times. For example, combustion may be fed a first fuel, such as methanol, a second fuel such as jet fuel, and a third fuel such as methane. The different fuels may be fed at different times. A switch may be utilized to change the fuel being fed via the fuel conduit to the combustion chamber. For example, the three different fuels may be within different storage tanks that are in communication with a feed conduit of the combustion via separate conduits. A valve or switch may be positioned between the feed conduit and fuel source conduits. The position of the switch or valve may be changed from a first position to a second position or a third position to change the fuel being fed to the combustion chamber via the feed conduit. A fuel metering orifice or other flow regulator may also be included in the feed conduit or switch to regulate the fuel flow rate. A change in the position of the switch or valve to any of the three positions may be made to adjust which fuel is fed to the combustion chamber.

The oxidizer may be air pumped into a separate oxidizer conduit or may be air fed into the feed conduit that also receives the fuel. For example, air may be compressed and subsequently blown into the combustion chamber via a compressor in communication with an oxidizer feed conduit. Alternatively, oxygen, hydrogen peroxide, nitrous oxide or other concentrated oxidizer may be stored in a storage tank and fed via a conduit to the combustion chamber.

Embodiments of the invention may be configured to maximize furnace efficiency of the combustor by eliminating the thermal parasitic heat loss through the combustor walls. Since the combustor and heat exchanger are embedded within an enclosure containing the heat transfer fluid, all or substantially all of the heat transfer through the combustion chamber and heat exchanger walls is energy available to the heat engine rather than heating the environment, which is a thermal loss to the conventional systems utilizing a direct fired combustor. As should be appreciated by those of at least ordinary skill in the art, the combustion chamber 3 and heat exchanger 4 may be designed to include large surface area to volume ratios so that the heat of the combustion products transfers through the combustor walls with a high effectiveness, which is also easily increased by adding length or surface area to the heat exchanger positioned within the enclosure. Such length may be added, for example, by having a conduit define a serpentine or coiled path within the enclosure. Alternatively, parallel flow paths of the heat transfer fluid 5 and combustion products may be utilized similar to those in a shell and tube heat exchanger. The combustion products passing through the heat exchanger 4 may be cooled to the temperature of the heat transfer fluid 5 before exiting the enclosure 8.

Further, unlike conventional systems utilizing a direct fired combustor, the combustor exhaust pressure can be increased without a redesign of a hot side 7 of the heat engine, such as a hot side heat exchanger of the hot side 7 of the heat engine. Since the heat engine and combustor are decoupled via the heat transfer fluid, isolating the combustion gas from the hot side of the heat engine has a further advantage in that no diluents are required in the combustor. The powering system designs described and disclosed herein permit designs to provide stoichiometric combustion without any use of a diluent, which results in increased efficiency and other functional improvements over conventional designs. Typically, conventional systems utilize a combustor that requires a significant flow rate of diluents, such as excess air or exhaust gas, into the combustor to limit the exhaust gas temperature so that the combustor walls or hot side of a heat engine are not damaged or melted by the hot combustion products. The flow rate of the diluents can be, for example, five to twenty times that of the fuel and oxidizer flow rates in a direct fired combustor system. Such a large flow rate of diluents also requires a parasitic pumping loss, which requires shaft power or electrical power generated by the heat engine that degrades the overall efficiency of the power system. Higher flow rates also increase the required size, weight and volume of the combustor component.

Figure 5:
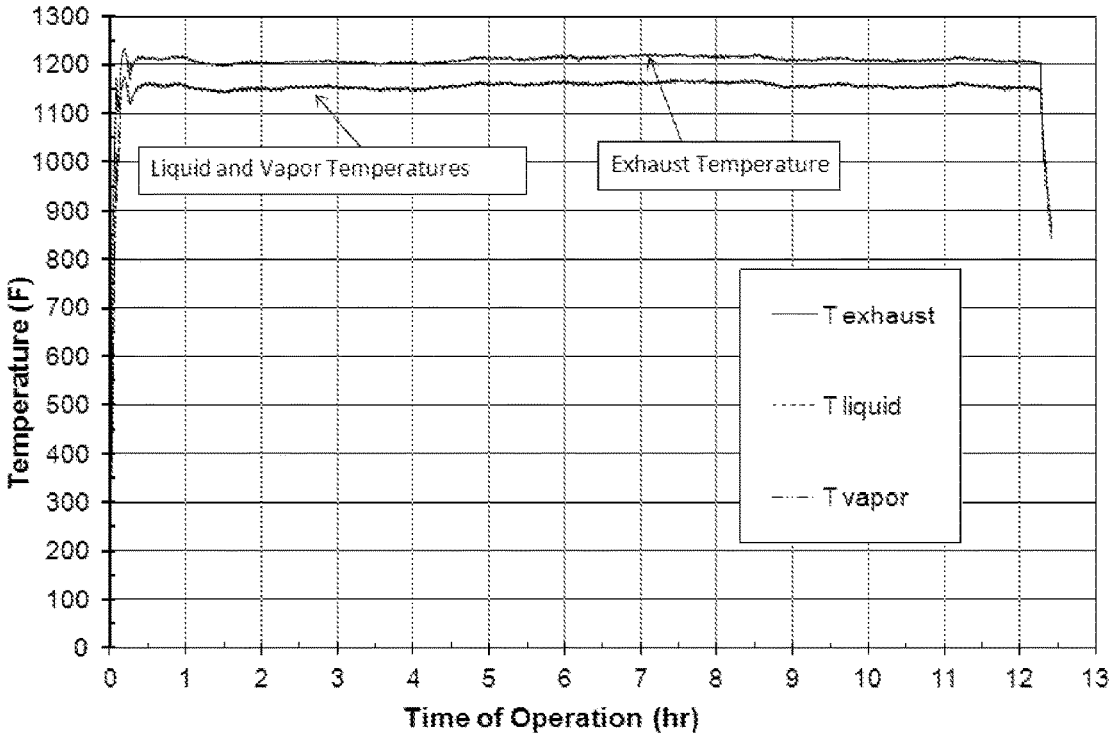
FIG. 5 is a graph illustrating testing results for a conducted test of one embodiment of the powering system showing representative temperatures.
Figure 6:
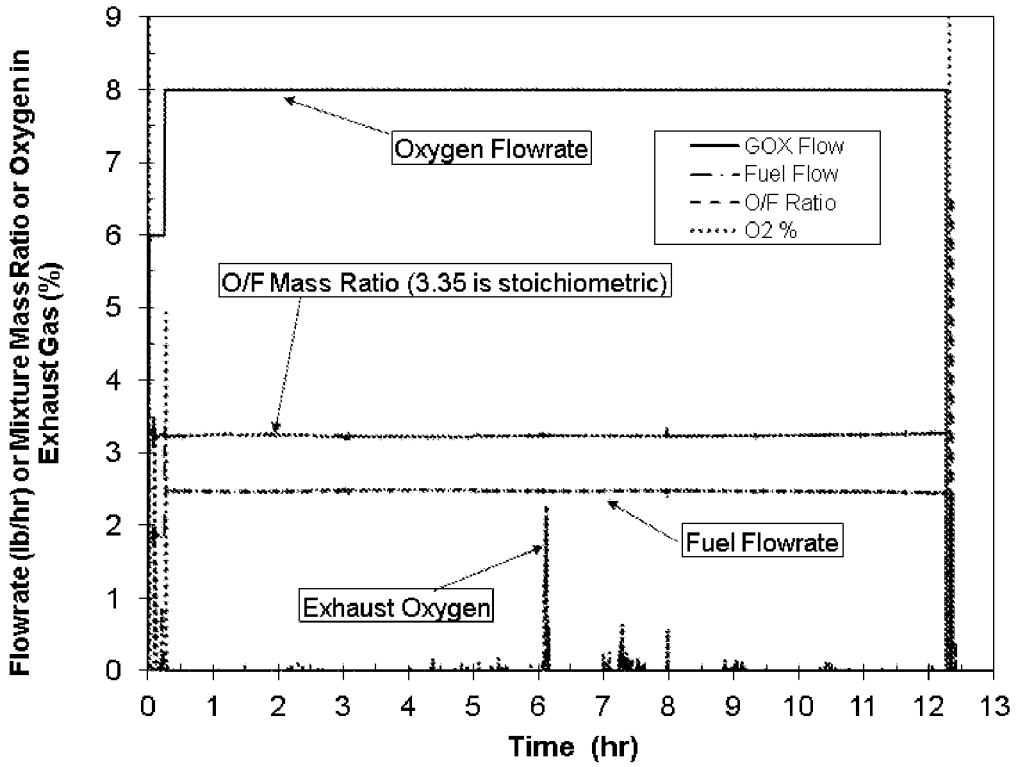
FIG. 6 is a graph illustrating testing results for a conducted test of one embodiment of the powering system showing propellant flows and exhaust gas analysis.

Embodiments of the powering system were rigorously tested in all three of the interfaces shown in FIGS. 1, 2, and 3. FIGS. 5 and 6 show data from one test of this device, in which a combustor was embedded within a pipe cap containing sodium as per the pool boiler configuration of FIG. 2. The heat of combustion from burning oxygen with jet fuel was transferred through the combustor walls and heat exchanger to boil sodium metal. The sodium vapor then condensed on a flat plate that sealed the pipe cap, which formed an enclosure for the sodium metal. The flat plate was externally spray cooled with a water mist to simulate powering a Stirling heat engine. FIG. 5 provides temperature data from the testing of this interface during a 12 hour endurance test. Thermocouples in the liquid sodium, T liquid, as well as those in the sodium vapor space, T vapor, were nearly isothermal at nominally 1150° F. and are nearly indistinguishable in FIG. 5. The sodium temperature of 1150° F. was maintained in thermal equilibrium by extracting approximately 12 kW of thermal power from the top plate. The combustor and engine interface was manually controlled, very stable and required only minor adjustments in the heat rejection rate (spray cooling) to maintain the sodium temperature near 1150° F. Note that thermocouple T vapor was positioned in the vapor space in close proximity to the top plate, where sodium vapor condensed to simulate the hot side of the heat engine. Also shown in FIG. 5 is the combustion exhaust gas temperature, T exhaust, which was measured at the exit of the pool boiler enclosure. The combustion exhaust products were cooled from the adiabatic flame temperature to within 50° F. of the pool boiling temperature. The heat exchanger plumbing within the enclosure was only about thirty inches in length, yet the exhaust products were cooled from nearly 6000° F. to 1200° F. It is contemplated that other designs may utilize a longer heat exchanger conduit within the enclosure so that the exhaust products can be cooled within about 20° F. of the heat transfer fluid (sodium metal) temperature. It should be appreciated that for a Stirling engine, the best efficiency possible is to emit the exhaust products at the hot side temperature of the heat engine. Considering that the combustor has no additional parasitic heat losses or diluents, the efficiency of the combustor and engine interface approaches the highest that can be thermodynamically achieved. The fuel and oxidizer flow rates for the conducted endurance test are shown in FIG. 6. The propellant mass flow rates were nearly stoichiometric and without any added diluents, as shown by the oxygen to fuel ratio in FIG. 6 being nearly equal to 3.35 pounds of oxygen per pound of jet fuel. FIG. 6 also shows the measured oxygen concentration in the exhaust gas was nearly zero for the entire test, other than during the initial transition to full power and during some fuel flow perturbations that occurred over the course of the test. The test results of FIG. 6 prove that complete combustion was achieved.

It should be appreciated that embodiments of the powering system permit the use of a heat pipe, pool boiler, or thermosyphon design to reduce parasitic loss in powering systems while also eliminating the need for pumping excess diluent into the combustor or combustor exhaust stream. Embodiments of the powering system may also eliminate hot spots on the engine's hot side, minimize the needed surface area for a hot side of a heat engine, and maximize the thermal efficiency of the power system. Use of the intermediate transfer fluid decouples the heat engine exhaust from the heat engine, which may help eliminate the need for adding excess diluent to the combustor. For instance, pure oxygen can be burned with a hydrocarbon fuel without requiring a diluent to temper the exhaust even though the exhaust may exceed 5000° F. in temperature. The decoupling of the exhaust gas from the engine also permit the hot side of the heat engine to not be exposed to the hot exhaust products which also eliminates the pumping of diluents into the combustor that degrades the net efficiency of the power system.

Figure 7:
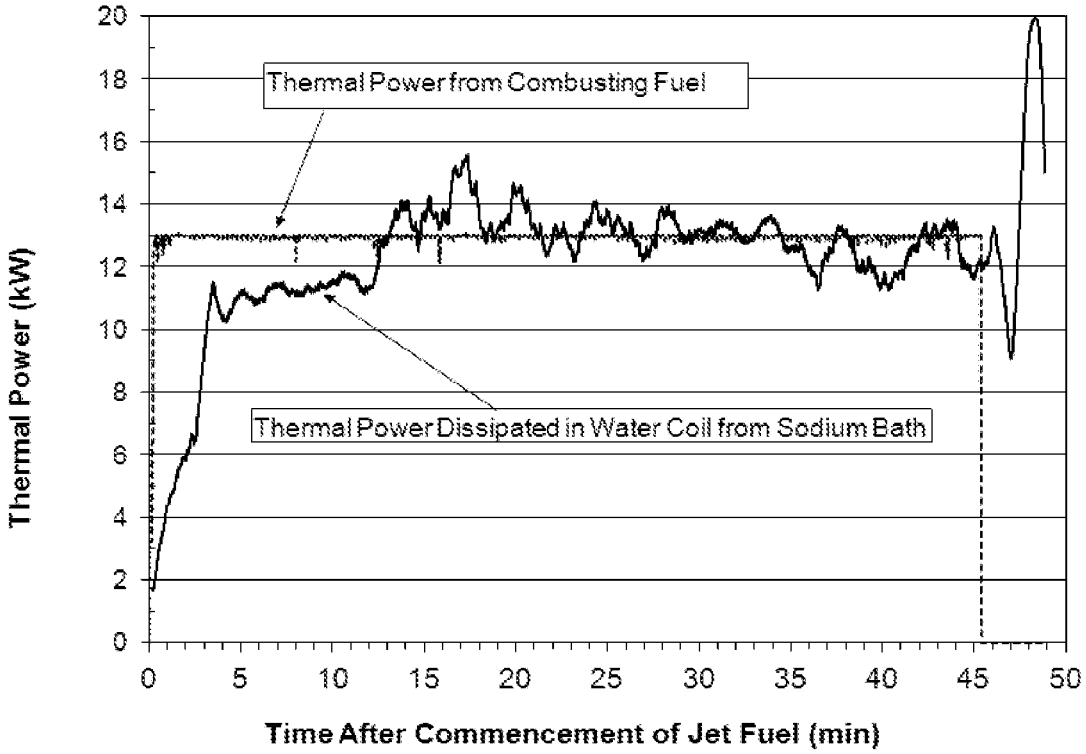
FIG. 7 is a graph illustrating testing results of a test conducted for an embodiment of the powering system demonstrating a high furnace efficiency.

Proof of the energy efficiency of embodiments of the invention may be difficult when using water spray cooling, since the water spray evaporates from the hot top plate surface during the above mentioned testing. Similarly, a power balance is also difficult with an actual heat engine, as the thermal efficiency of the engine may not be well known or calibrated. However, the efficiency obtained by embodiments of the invention was better demonstrated in another conducted test. That test utilized a water coil that was immersed in the liquid sodium metal along with the combustor as per the convectively cooled design of FIG. 3. A power balance between the thermal power extracted from the cooling coil and the thermal power calculated from the combustion of fuel and oxidizer verified a very high efficiency. FIG. 7 illustrates the thermal power of combustion and the thermal power dissipated in the water coil from the sodium bath. The power resulting from the burning of the fuel and oxidizer and the thermal power extracted from the enclosure, which contained the combustor and liquid sodium, is shown in FIG. 7. During the first twelve minutes of the test, the sodium liquid and enclosure heated from about 300° F. to a desired steady state operating temperature of 1100° F. The heat of combustion was therefore absorbed as heat capacity within the system as measured by the conducted test. After steady-state temperatures were achieved at times of 13 to 45 minutes, the thermal power extracted from the cooling coil was very nearly equal to the thermal power generated by combustion, which indicates a very high efficiency. Stated another way, the chemical power of combustion was efficiently transferred to a heat exchanger that could have powered a heat engine as measured by the test as shown in the test results of FIG. 7. Alternately, the steam that was efficiently produced in this coil could have been used externally, for example to power a Rankine cycle engine.

Embodiments of the system that utilize a heat transfer fluid that boils or evaporates have further advantages. For example, use of such a heat transfer fluid permits high heat transfer rates on combustor walls that prevent melting or over temperature of the walls while also providing a high, nearly isothermal heat flux on the hot side of the thermal engine caused by condensing vapor that may contact the hot side of the engine. This can eliminate potential problems with hot spots or over temperature of the engine as might be problematic with a direct fired combustor. Also, the high heat fluxes associated with a condensing fluid of the engine can reduce, if not eliminate, the need for large surface areas or extended heat transfer surfaces that result in compact hot side heat engines that can be easier to manufacture and use less weight than conventional designs utilizing a direct fired combustor.

The furnace efficiency of embodiments of the powering system may be easily optimized to achieve a particular design objective for use in connection with powering a device as well. Adding length or surface area to the heat exchanger positioned downstream from the combustor and housed within an enclosure of a heat pipe, pool boiler, or thermospyhpon can increase the heat transfer to the heat transfer fluid. The furnace efficiency can be maximized by the surface area of the combustor being designed so that the combustion exhaust gases are cooled to approximately the temperature of the heat transfer fluid. For the case of a Stirling heat engine, this would be approximately the heater head temperature of the Stirling heat engine.

While various embodiments of the power system have been discussed above it should be appreciated that variations to those designs may be made within the spirit and scope of the claims. For example, sizes and dimensions of the enclosure, combustion chamber, heat exchanger, and engine may be any of a number of different options to meet a particular design criteria. As another example, any of a number of Stirling engines or heat engines as well as multiple combustors may be utilized in embodiments of the powering system. As another example, heat could be withdrawn from the heat exchanger by a fluid, such as water or an organic medium, flowing through heat exchanger coils, with this hot fluid used externally to drive an engine or for another process. As yet another example, the oxidizer and fuel used for combustion within the combustion chamber may be any of a number of different suitable combinations.

Therefore it should be understood that while certain present preferred engines and powering systems utilized by such engines and methods of making and using the same have been discussed and illustrated herein, it is to be distinctly understood that the invention is not limited thereto but may be otherwise variously embodied and practiced within the scope of the following claims.

What is claimed is:

1. A powering system comprising:

an engine having a first side;

an interface for providing heat to the first side of the engine, the interface comprising:

an enclosure;

a combustor having a combustion chamber positioned at least partially in the enclosure, the combustion chamber configured for receiving a fuel and an oxidizer without a diluent for combustion of the fuel and oxidizer into a combustion product, wherein the fuel is jet fuel, methane, an alcohol, kerosene, or a hydrocarbon fuel, wherein said fuel is a hydrocarbon fuel with a combustion exhaust temperature that exceeds 5,000 F when burned by said combustor with oxygen in the absence of said diluent;

a conduit connected to the combustion chamber for receiving the combustion product; the conduit being positioned at least partially in the enclosure;

a heat transfer fluid positioned in the enclosure, the heat transfer fluid adjacent an external surface of at least one wall of the combustion chamber and an external surface of the conduit within the enclosure, the heat transfer fluid being heated by the combustion product via the external surface of the combustion chamber and the external surface of the conduit such that the heat transfer fluid transfers heat to the first side of the engine; and a heat transfer fluid movement mechanism connected to the enclosure, the heat transfer fluid movement mechanism moving the fluid;

wherein the heat transfer fluid is heated by the combustion product via the external surface of the combustion chamber and the external surface of the conduit such that the heat transfer fluid boils and vapor contacts the first side of the heat engine and condenses adjacent the first side of the heat engine to transfer heat to the first side of the engine;

wherein a portion of the conduit within the enclosure is coiled or serpentine tubing or is a conduit that defines a coiled or serpentine path within the enclosure;

wherein the heat transfer fluid is a liquid metal.

2. The powering system of claim 1 wherein the engine is a Stirling engine, Rankine cycle engine, Brayton cycle engine, external combustion engine, or a heat engine.

3. The powering system of claim 1 wherein the first side of the engine is a hot side of the engine and the hot side of the engine is comprised of a heat exchanger.

4. The powering system of claim 1 wherein the heat transfer fluid is a liquid and the combustion chamber and a portion of the conduit are positioned within the liquid.

5. The powering system of claim 1 wherein the combustion chamber does not receive any diluent and the external surface of the combustion chamber directly contacts the heat transfer fluid.

6. The powering system of claim 1 further comprising:

a recuperator connected to the conduit so that heat from the combustion product passing through the conduit preheats at least one of the fuel and the oxidizer prior to the at least one of the fuel and the oxidizer being fed to the combustion chamber.

7. The powering system of claim 6, wherein the conduit has an exhaust outlet and the combustion product is passed through the exhaust outlet after passing through the recuperator.

8. The powering system of claim 1 wherein the portion of the conduit is a heat exchanger and the combustion of the fuel and oxidizer is a complete combustion when the combustor operates at a steady state condition.

9. The powering system of claim 1 wherein a first portion of the conduit is within the enclosure, a second portion of the conduit is within a recuperator and a third portion of the conduit is between the recuperator and the first portion of the conduit.

10. The powering system of claim 1, wherein the engine generates mechanical work or electrical work.

11. The powering system of claim 1 wherein the engine is an engine of a vehicle.

12. The powering system of claim 1 wherein the first side of the engine is a component of a Rankine cycle engine and wherein the engine is a Rankine cycle engine.

13. The powering system of claim 1, wherein the heat transfer fluid side of the combustor's combustion chamber section walls and the section of the conduit within the enclosure and in contact with the heat transfer fluid are formed or covered with a wick structure, knurling, texturizing structures, or thermal energy transfer fins to facilitate transfer of heat from the combustor and the conduit into the heat transfer fluid.

14. A powering system for a vehicle comprising:

a powertrain supported by said vehicle;

an engine coupled with said powertrain, said engine having a hot side; and interface means for providing heat to the hot side of the engine, the interface means comprising:

an enclosure;

a combustor means configured for receiving a fuel and an oxidizer without a diluent for combustion of the fuel and oxidizer into a combustion product, the combustor means positioned entirely within the enclosure, wherein the fuel is jet fuel, methane, an alcohol, kerosene, or a hydrocarbon fuel, wherein said fuel is a hydrocarbon fuel with a combustion exhaust temperature that exceeds 5,000 F when burned with oxygen in the absence of said diluent;

a heat exchanger means for receiving the combustion product and cooling the combustion product; the heat exchanger means being connected to the combustor means and being positioned within the enclosure;

a heat transfer fluid positioned in the enclosure to decouple the engine from the combustor means, the heat transfer fluid engaging the combustor means and the heat exchanger mean to receive heat from the combustor means and the heat exchanger means to transfer the heat to the hot side of the engine; and a heat transfer fluid movement mechanism connected to the enclosure, the heat transfer fluid movement mechanism moving the fluid;

wherein the heat transfer fluid is heated by the combustion product via interface with the combustor means and an external surface of the heat exchanger means such that the heat transfer fluid boils and vapor contacts the hot side of the engine and condenses adjacent to the hot side and thereby transfers heat to the hot side of the engine;

wherein a portion of the combustor means within the enclosure comprises coiled or serpentine tubing or comprises a conduit that defines a coiled or serpentine path within the enclosure;

wherein the fluid is a liquid metal.

15. The powering system of claim 14 wherein the enclosure is a housing.

16. The powering system of claim 14 wherein the engine is a Stirling engine and the hot side of the Stirling engine is a heater head of the Stirling engine, or the engine is a heat engine and wherein the engine produces mechanical work or electrical work.

17. The powering system of claim 14 wherein the combustor means is operated without use of any diluent.

18. The powering system of claim 14 wherein the heat transfer fluid is in direct contact with the hot side of the engine to transport heat to the hot side of the engine.

19. The powering system of claim 14 wherein a predetermined residence time of the gases that exit the combustor means and enter the heat exchanger is provided via a length of the heat exchanger means so that the any unburned propellants or reduction of incomplete combustion products are converted to their final equilibrium state to maximize furnace efficiency of the combustor means.

20. The powering system of claim 1, wherein said coiled or serpentine tubing or said conduit has a length operable to transfer heat of said combustion product to within 99 F or less of the first side of the engine during operation.

21. The powering system of claim 1, wherein said coiled or serpentine tubing or said conduit has a length operable to transfer heat of said combustion product to within 20 F or less of the first side of the engine during operation.

22. The powering system of claim 14, wherein said coiled or serpentine tubing or said conduit has a length operable to transfer heat of said combustion product to within 99 F or less of the hot side of the engine during operation.

23. The powering system of claim 14, wherein said coiled or serpentine tubing or said conduit has a length operable to transfer heat of said combustion product to within 20 F or less of the hot side of the engine during operation.

24. A powering system comprising:

an engine having a first side;

a heat transfer interface for providing heat to the first side of the engine, the interface comprising:

an enclosure;

a combustor having a combustion chamber positioned in the enclosure, the combustion chamber section configured for receiving a fuel and an oxidizer without a diluent and combusting the fuel and oxidizer into a combustion product within the combustion chamber and thereby transferring thermal energy from the combustion product directly into the enclosure, wherein said fuel is jet fuel, methane, an alcohol, kerosene, or a hydrocarbon fuel, wherein said fuel is a hydrocarbon fuel with a combustion product temperature produced by said combustor that exceeds 5,000 F when burned with oxygen in the absence of said diluent;

a conduit connected to the combustion chamber section for receiving the combustion product, the conduit being positioned at least partially in the enclosure, the conduit coupled to an exhaust system transferring the combustion product outside of the powering system;

a heat transfer fluid disposed in the enclosure such that there is a gap between the heat transfer fluid and the first side of the engine extending into the enclosure, the heat transfer fluid in contact with an external surface of at least one wall of the combustion chamber section and an external surface of the conduit within the enclosure, the heat transfer fluid being heated by the combustion product via the external surface of the combustion chamber and the external surface of the conduit; and a heat transfer fluid movement mechanism connected to the enclosure, the heat transfer fluid movement mechanism moving the fluid;

wherein the heat transfer fluid is heated by the combustion product via the external surface of the combustion chamber section and the external surface of the conduit such that the heat transfer fluid boils and heat transfer fluid gas or vapor contacts the first side of the heat engine and condenses adjacent the first side of the heat engine to transfer heat to the first side of the engine.

25. The powering system of claim 24 wherein the engine is a Stirling engine, Rankine cycle engine, Brayton cycle engine, external combustion engine, or a heat engine.

26. The powering system of claim 24 wherein the first side of the engine is a hot side of the engine and the hot side of the engine is comprised of a heat exchanger.

27. The powering system of claim 24 wherein the heat transfer fluid is a liquid and the combustion chamber section and a portion of the conduit are positioned within the liquid.

28. The powering system of claim 24 wherein the combustion chamber does not receive any diluent and the external surface of the combustion chamber directly contacts the heat transfer fluid.

29. The powering system of claim 24 further comprising a recuperator connected to the conduit so that heat from the combustion product passing through the conduit preheats at least one of the fuel and the oxidizer prior to the at least one of the fuel and the oxidizer being fed to the combustion chamber section.

30. The powering system of claim 29, wherein the conduit has an exhaust outlet and the combustion product is passed through the exhaust outlet after passing through the recuperator.

31. The powering system of claim 24 wherein a portion of the conduit is a heat exchanger and the combustion of the fuel and oxidizer is a complete combustion when the combustor operates at a steady state condition.

32. The powering system of claim 24 wherein a first portion of the conduit is within the enclosure, a second portion of the conduit is within a recuperator and a third portion of the conduit is between the recuperator and the first portion of the conduit.

33. The powering system of claim 24, wherein the engine generates mechanical work or electrical work.

34. The powering system of claim 24 wherein the engine is an engine of a vehicle.

35. The powering system of claim 24 wherein the first side of the engine is a component of a Rankine cycle engine and wherein the engine is a Rankine cycle engine.

36. The powering system of claim 24, wherein the conduit within the enclosure is coiled or serpentine tubing or is a conduit that defines a coiled or serpentine path within the enclosure.

37. The powering system of claim 24, wherein the combustor's combustion chamber section is positioned within the enclosure so that the heat transfer fluid surround all sides of said combustor's combustion chamber section and sections of said conduit that are within the enclosure.

38. The powering system of claim 24, wherein the heat transfer fluid is a liquid metal.

39. The powering system of claim 24, wherein the heat transfer fluid side of the combustor's combustion chamber section walls and the section of the conduit within the enclosure and in contact with the heat transfer fluid are formed or covered with a wick structure, knurling, texturizing structures, or thermal energy transfer fins to facilitate transfer of heat from the combustor and the conduit into the heat transfer fluid.

40. A mobile structure with a powering system comprising:

a mobile support frame;

a power train coupled with the mobile support frame;

an engine coupled with the power train adapted to produce and deliver energy to the power train, the engine having a first side;

a heat production section supported within the mobile support frame, said heat production section comprising an interface for providing heat to the first side of the engine, the interface comprising:

an enclosure;

a combustor having a combustion chamber positioned at least partially in the enclosure, the combustion chamber configured for receiving a fuel and an oxidizer without a diluent for combustion of the fuel and oxidizer into a combustion product, wherein the fuel is jet fuel, methane, an alcohol, kerosene, or a hydrocarbon fuel, wherein said fuel is a hydrocarbon fuel with a combustion exhaust temperature that exceeds 5,000 F when burned by said combustor with oxygen in the absence of said diluent;

a conduit connected to the combustion chamber for receiving the combustion product; the conduit being positioned at least partially in the enclosure;

a heat transfer fluid positioned in the enclosure, the heat transfer fluid adjacent an external surface of at least one wall of the combustion chamber and an external surface of the conduit within the enclosure, the heat transfer fluid being heated by the combustion product via the external surface of the combustion chamber and the external surface of the conduit such that the heat transfer fluid transfers heat to the first side of the engine; and a heat transfer fluid movement mechanism connected to the enclosure, the heat transfer fluid movement mechanism moving the fluid;

wherein the heat transfer fluid is heated by the combustion product via the external surface of the combustion chamber and the external surface of the conduit such that the heat transfer fluid boils and vapor contacts the first side of the heat engine and condenses adjacent the first side of the heat engine to transfer heat to the first side of the engine;

wherein a portion of the conduit within the enclosure is coiled or serpentine tubing or is a conduit that defines a coiled or serpentine path within the enclosure;

wherein the heat transfer fluid is a liquid metal.

41. The mobile structure with a powering system of claim 40, wherein the engine is a Stirling engine, Rankine cycle engine, Brayton cycle engine, external combustion engine, or a heat engine.

42. The mobile structure with a powering system of claim 40, wherein the first side of the engine is a hot side of the engine and the hot side of the engine is comprised of a heat exchanger.

43. The mobile structure with a powering system of claim 40, wherein the heat transfer fluid is a liquid and the combustion chamber and a portion of the conduit are positioned within the liquid.

44. The mobile structure with a powering system of claim 40, wherein the combustion chamber does not receive any diluent and the external surface of the combustion chamber directly contacts the heat transfer fluid.

45. The mobile structure with a powering system of claim 40, further comprising:

a recuperator connected to the conduit so that heat from the combustion product passing through the conduit preheats at least one of the fuel and the oxidizer prior to the at least one of the fuel and the oxidizer being fed to the combustion chamber.

46. The mobile structure with a powering system of claim 45, wherein the conduit has an exhaust outlet and the combustion product is passed through the exhaust outlet after passing through the recuperator.

47. The mobile structure with a powering system of claim 40, wherein the portion of the conduit is a heat exchanger and the combustion of the fuel and oxidizer is a complete combustion when the combustor operates at a steady state condition.

48. The mobile structure with a powering system of claim 40, wherein a first portion of the conduit is within the enclosure, a second portion of the conduit is within a recuperator and a third portion of the conduit is between the recuperator and the first portion of the conduit.

49. The mobile structure with a powering system of claim 40, wherein the engine generates mechanical work or electrical work.

50. The mobile structure with a powering system of claim 40, wherein power train further comprises a propeller or a drive shaft operable to move the mobile structure in combination with other mobile structure components.

51. The powering system of claim 40, wherein the heat transfer fluid side of the combustor's combustion chamber section walls and the section of the conduit within the enclosure and in contact with the heat transfer fluid are formed or covered with a wick structure, knurling, texturizing structures, or thermal energy transfer fins to facilitate transfer of heat from the combustor and the conduit into the heat transfer fluid.

52. A mobile structure with a powering system comprising:

a mobile support frame;

a mobile structure power train coupled with the mobile support frame;

an engine coupled with the power train adapted to produce and deliver energy to the power train, the engine having a first side;

an interface for providing heat to the first side of the engine, the interface comprising:

an enclosure;

a combustor having a combustion chamber positioned in the enclosure, the combustion chamber section configured for receiving a fuel and an oxidizer without a diluent and combusting the fuel and oxidizer into a combustion product within the combustion chamber and thereby transferring thermal energy from the combustion product directly into the enclosure, wherein the fuel is jet fuel, methane, an alcohol, kerosene, or a hydrocarbon fuel, wherein said fuel is a hydrocarbon fuel with a combustion exhaust temperature that exceeds 5,000 F when burned by said combustor with oxygen in the absence of said diluent;

a conduit connected to the combustion chamber section for receiving the combustion product, the conduit being positioned at least partially in the enclosure, the conduit coupled to an exhaust system transferring the combustion product outside of the powering system;

a heat transfer fluid disposed in the enclosure such that there is a gap between the heat transfer fluid and the first side of the engine extending into the enclosure, the heat transfer fluid in contact with an external surface of at least one wall of the combustion chamber section and an external surface of the conduit within the enclosure, the heat transfer fluid being heated by the combustion product via the external surface of the combustion chamber and the external surface of the conduit; and a heat transfer fluid movement mechanism connected to the enclosure, the heat transfer fluid movement mechanism moving the fluid;

wherein the heat transfer fluid is heated by the combustion product via the external surface of the combustion chamber section and the external surface of the conduit such that the heat transfer fluid boils and heat transfer fluid gas or vapor contacts the first side of the heat engine and condenses adjacent the first side of the heat engine to transfer heat to the first side of the engine.

53. A mobile structure with a powering system as in claim 52, wherein the engine is a Stirling engine, Rankine cycle engine, Brayton cycle engine, external combustion engine, or a heat engine.

54. A mobile structure with a powering system as in claim 52, wherein the first side of the engine is a hot side of the engine and the hot side of the engine is comprised of a heat exchanger.

55. A mobile structure with a powering system as in claim 52, wherein the heat transfer fluid is a liquid and the combustion chamber section and a portion of the conduit are positioned within the liquid.

56. A mobile structure with a powering system as in claim 52, wherein the combustion chamber does not receive any diluent and the external surface of the combustion chamber directly contacts the heat transfer fluid.

57. A mobile structure with a powering system as in claim 52, further comprising a recuperator connected to the conduit so that heat from the combustion product passing through the conduit preheats at least one of the fuel and the oxidizer prior to the at least one of the fuel and the oxidizer being fed to the combustion chamber section.

58. A mobile structure with a powering system as in claim 57, wherein the conduit has an exhaust outlet and the combustion product is passed through the exhaust outlet after passing through the recuperator.

59. A mobile structure with a powering system as in claim 52, wherein a portion of the conduit is a heat exchanger and the combustion of the fuel and oxidizer is a complete combustion when the combustor operates at a steady state condition.

60. A mobile structure with a powering system as in claim 52, wherein a first portion of the conduit is within the enclosure, a second portion of the conduit is within a recuperator and a third portion of the conduit is between the recuperator and the first portion of the conduit.

61. A mobile structure with a powering system as in claim 52, wherein the engine generates mechanical work or electrical work.

62. A mobile structure with a powering system as in claim 52, wherein the conduit within the enclosure is coiled or serpentine tubing or is a conduit that defines a coiled or serpentine path within the enclosure.

63. A mobile structure with a powering system as in claim 52, wherein the combustor's combustion chamber section is positioned within the enclosure so that the heat transfer fluid surround all sides of said combustor's combustion chamber section and sections of said conduit that are within the enclosure.

64. A mobile structure with a powering system as in claim 52, wherein the heat transfer fluid is a liquid metal.

65. A mobile structure with a powering system as in claim 52, wherein the heat transfer fluid side of the combustor's combustion chamber section walls and the section of the conduit within the enclosure and in contact with the heat transfer fluid are formed or covered with a wick structure, knurling, texturizing structures, or thermal energy transfer fins to facilitate transfer of heat from the combustor and the conduct into the heat transfer fluid.

* * * * *